US010605081B2

(12) United States Patent
Schneider et al.

(10) Patent No.: US 10,605,081 B2
(45) Date of Patent: Mar. 31, 2020

(54) FREE-PISTON DEVICE AND METHOD FOR OPERATING A FREE-PISTON DEVICE

(71) Applicant: Deutsches Zentrum für Luft- und Raumfahrt e.V., Cologne (DE)

(72) Inventors: Stephan Schneider, Stuttgart (DE); Florian Kock, Stuttgart (DE)

(73) Assignee: Deutsches Zentrum für Luft- und Raumfahrt e.V. (DE)

( * ) Notice: Subject to any disclaimer, the term of this patent is extended or adjusted under 35 U.S.C. 154(b) by 0 days.

(21) Appl. No.: 16/192,301

(22) Filed: Nov. 15, 2018

(65) Prior Publication Data

US 2019/0085696 A1 Mar. 21, 2019

Related U.S. Application Data

(63) Continuation of application No. PCT/EP2017/061522, filed on May 12, 2017.

(30) Foreign Application Priority Data

May 17, 2016 (DE) ..... 10 2016 109 055

(51) Int. Cl.
*F02B 71/00* (2006.01)
*F01B 11/00* (2006.01)
(Continued)

(52) U.S. Cl.
CPC ..... *F01B 11/007* (2013.01); *F01B 7/02* (2013.01); *F01B 11/02* (2013.01); *F01P 3/02* (2013.01);
(Continued)

(58) Field of Classification Search
CPC ..... F02B 63/041; F02B 71/00; F02B 75/282; F02B 25/08; F02B 71/06; F01B 11/00
(Continued)

(56) References Cited

U.S. PATENT DOCUMENTS 3,411,289 A 11/1968 Antonsen et al.
4,048,970 A 9/1977 Fitzgerald
(Continued)

FOREIGN PATENT DOCUMENTS

AU 6302199 A 6/2001
AU 4205001 A 12/2001
(Continued)

OTHER PUBLICATIONS

International Preliminary Report on Patentability for Application No. PCT/EP2017/061522, dated Nov. 20, 2018—8 pages, 2019.
(Continued)

*Primary Examiner* — Long T Tran
*Assistant Examiner* — James J Kim
(74) *Attorney, Agent, or Firm* — RatnerPrestia

(57) ABSTRACT

A free piston apparatus includes a piston receptacle in which a piston device having a piston is linearly reciprocable. The piston receptacle includes or forms a combustion chamber delimited by a wall arrangement forming a first opening and a second opening. The openings include an inlet opening for the supply of fresh gas and an outlet opening for the removal of exhaust gas for a uniflow scavenging of the combustion chamber. Movement of the piston device is controllable by a control device. The bottom dead center of the piston can be adjustable such that when the piston adopts the bottom dead center, the first opening is partially unblocked and partially blocked for adjusting a free cross sectional area of the first opening. An opening duration can also be adjustable. A method for operating a free piston apparatus includes controlling movement of a piston device with a control device.

18 Claims, 5 Drawing Sheets

Figure 1:
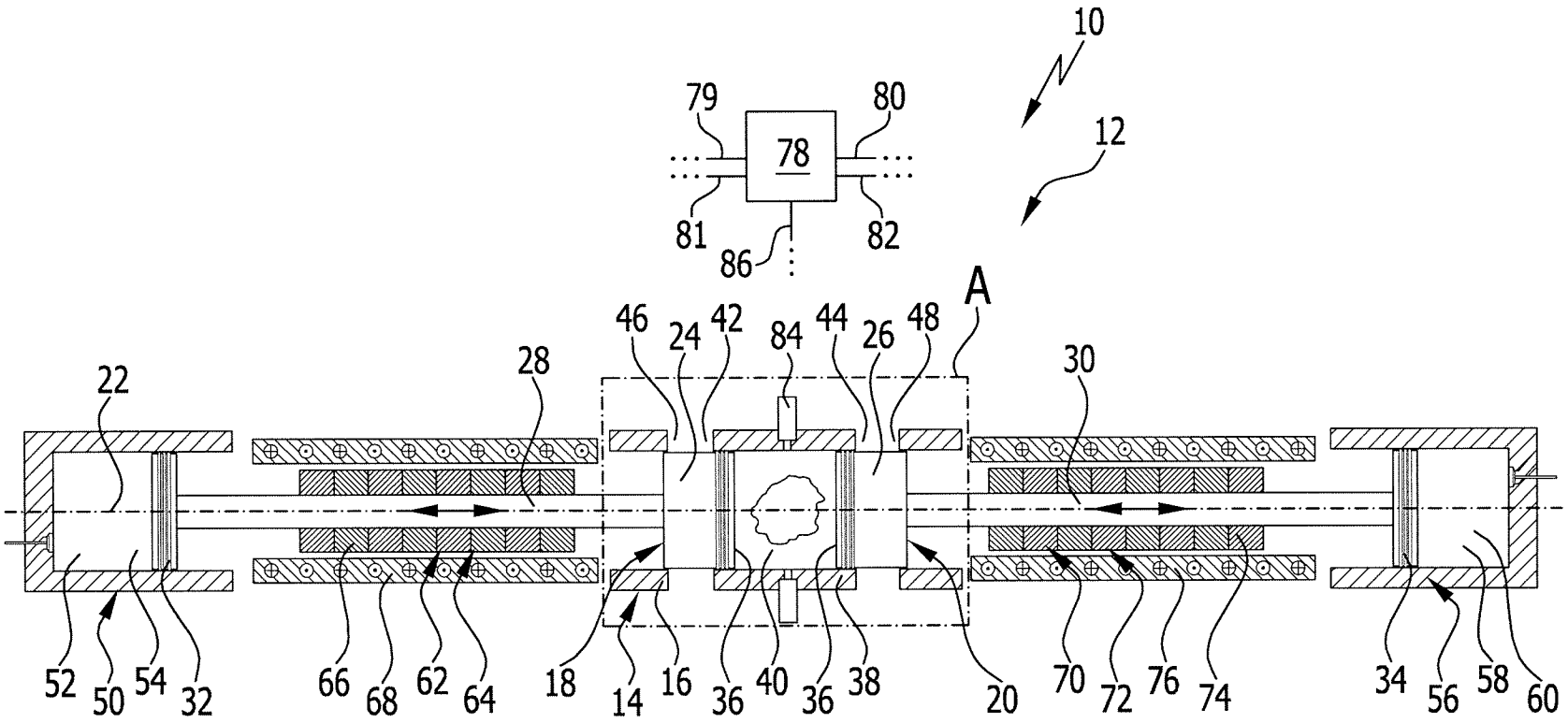

(51) Int. Cl.

| | |
|---|---|
| ***F01B 11/02*** | (2006.01) |
| ***F01B 7/02*** | (2006.01) |
| ***F02B 63/04*** | (2006.01) |
| ***F02B 75/28*** | (2006.01) |
| ***F01P 3/02*** | (2006.01) |
| ***F02B 71/04*** | (2006.01) |
| *F02B 75/02* | (2006.01) |

(52) U.S. Cl.
CPC ..... *F02B 63/041* (2013.01); *F02B 71/00* (2013.01); *F02B 71/04* (2013.01); *F02B 75/28* (2013.01); *F02B 75/282* (2013.01); *F02B 2075/025* (2013.01)

(58) Field of Classification Search
USPC ..... 123/46 E, 46 R
See application file for complete search history.

(56) References Cited

U.S. PATENT DOCUMENTS

| | | | | |
|---|---|---|---|---|
| 4,287,859 | A | 9/1981 | Noguchi et al. | |
| 5,002,020 | A | 3/1991 | Kos | |
| 5,893,343 | A | 4/1999 | Rigazzi | |
| 6,029,616 | A * | 2/2000 | Mayne | F01B 9/04 123/46 R |
| 6,138,639 | A | 10/2000 | Hiraya et al. | |
| 6,748,907 | B2 | 6/2004 | Malmquist et al. | |
| 6,904,876 | B1 | 6/2005 | Hofbauer et al. | |
| 7,082,909 | B2 | 8/2006 | Gräf et al. | |
| 7,258,085 | B2 * | 8/2007 | Niiyama | F02B 63/04 123/46 E |
| 8,887,690 | B1 * | 11/2014 | Sturman | F02B 47/04 123/27 R |
| 2002/0134324 | A1 | 9/2002 | Wehner | |
| 2003/0066499 | A1 * | 4/2003 | Berlinger | F01P 3/10 123/46 R |
| 2003/0094164 | A1 | 5/2003 | Lowi et al. | |
| 2005/0109295 | A1 * | 5/2005 | Kaneko | F02B 63/04 123/46 E |
| 2005/0274332 | A1 | 12/2005 | Lemke et al. | |
| 2006/0042575 | A1 | 3/2006 | Schmuecker et al. | |
| 2006/0124083 | A1 | 6/2006 | Niiyama et al. | |
| 2006/0201456 | A1 | 9/2006 | Hofbauer | |
| 2007/0261677 | A1 | 11/2007 | Bennion | |
| 2008/0036312 | A1 | 2/2008 | Max et al. | |
| 2009/0101005 | A1 | 4/2009 | Pohl et al. | |
| 2012/0112468 | A1 | 5/2012 | Najt et al. | |
| 2012/0186561 | A1 | 7/2012 | Bethel et al. | |
| 2012/0266851 | A1 | 10/2012 | Hofbauer et al. | |
| 2013/0014718 | A1 | 1/2013 | Shen et al. | |
| 2013/0167798 | A1 | 7/2013 | Lawler et al. | |
| 2013/0319368 | A1 | 12/2013 | Clarke | |
| 2015/0033736 | A1 | 2/2015 | Kalebjian et al. | |
| 2015/0300241 | A1 | 10/2015 | Holland | |
| 2016/0208686 | A1 * | 7/2016 | Gadda | F02B 63/041 |
| 2017/0204801 | A1 | 7/2017 | Sharma et al. | |
| 2017/0248099 | A1 | 8/2017 | Wagner et al. | |

FOREIGN PATENT DOCUMENTS

| | | | |
|---|---|---|---|
| AU | 2003232496 | A1 | 11/2003 |
| AU | 2003236392 | A1 | 5/2004 |
| CH | 188403 | A | 12/1936 |
| DE | 2844309 | A1 | 10/1979 |
| DE | 3103432 | A1 | 9/1982 |
| DE | 31114419 | A1 | 10/1982 |
| DE | 3047138 | A1 | 11/1982 |
| DE | 3438219 | A1 | 4/1986 |
| DE | 10219549 | B4 | 3/2004 |
| DE | 10242141 | A1 | 3/2004 |
| DE | 69817998 | T2 | 5/2004 |
| DE | 102004062440 | B4 | 9/2006 |
| DE | 102005006340 | A1 | 4/2007 |
| DE | 102005056823 | A1 | 5/2007 |
| DE | 102006029532 | A1 | 12/2007 |
| DE | 102008030633 | B4 | 4/2010 |
| DE | 102008053068 | A1 | 4/2010 |
| DE | 102008053069 | A1 | 5/2010 |
| DE | 102012111067 | B3 | 2/2014 |
| EP | 1398863 | A1 | 3/2004 |
| EP | 2224580 | A2 | 9/2010 |
| GB | 889509 | | 2/1962 |
| GB | 2334385 | A | 8/1999 |
| WO | 9533921 | A1 | 12/1995 |
| WO | 9728362 | A1 | 8/1997 |
| WO | 9813593 | A1 | 4/1998 |
| WO | 0145977 | A2 | 6/2001 |
| WO | 0194752 | A1 | 12/2001 |
| WO | 03091556 | A1 | 11/2003 |
| WO | 2004025098 | A1 | 3/2004 |
| WO | 2007010186 | A1 | 1/2007 |
| WO | 2007085344 | A1 | 8/2007 |
| WO | 2007147789 | A1 | 12/2007 |
| WO | 2008028216 | A1 | 3/2008 |
| WO | 2009156257 | A1 | 12/2009 |
| WO | 2010046120 | A1 | 4/2010 |
| WO | 2010046121 | A1 | 4/2010 |
| WO | 2012158756 | A1 | 11/2012 |

OTHER PUBLICATIONS

International Search Report and Written Opinion for Application No. PCT/EP2017/061522, dated Aug. 9, 2017—9 pages, 2019.
International Preliminary Report on Patentability for Application No. PCT/EP2017/061516, dated Nov. 20, 2018—6 pages.
International Search Report and Written Opinion for Application No. PCT/EP2017/061516, dated Aug. 9, 2017—7 pages.
International Search Report and Written Opinion for International Application No. PCT/EP2017/061495, dated Aug. 9, 2017—10 pages.
International Search Report and Written Opinion for International Application No. PCT/EP2017/061510, dated Aug. 10, 2017—9 pages.
International Preliminary Report on Patentability for International Application No. PCT/EP2017/061510, dated Nov. 20, 2018, 8 pages.
Notice of Allowance for U.S. Appl. No. 16/192,291, dated Oct. 28, 2019, 19 pages.
Non Final Office Action for U.S. Appl. No. 16/192,266, dated Feb. 5, 2020, 31 pages.
Non Final Office Action for U.S. Appl. No. 16/192,283, dated Feb. 6, 2020, 29 pages.

* cited by examiner

FREE-PISTON DEVICE AND METHOD FOR OPERATING A FREE-PISTON DEVICE

CROSS-REFERENCE TO RELATED APPLICATIONS

The present application is a continuation patent application of International Application No. PCT/EP2017/061522, filed on May 12, 2017, and claims the benefit of priority of German Application No. 10 2016 109 055.7, filed on May 17, 2016. The contents of International Application No. PCT/EP2017/061522 and German Application No. 10 2016 109 055.7 are incorporated by reference herein in their entireties and for all purposes.

FIELD

The present disclosure relates to a free piston apparatus, comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controllable by means of a control device.

Furthermore, the present disclosure relates to a method for operating a free piston apparatus of that kind.

BACKGROUND

DE 10 2008 053 069 A1 describes a free piston apparatus having two piston devices and pistons positioned in opposed piston arrangement. The piston of the first piston device unblocks at the bottom dead center an inlet opening and an outlet opening for a cross scavenging of the combustion chamber. The second piston device may be operated such that the second piston, depending on load, optionally unblocks or blocks an outlet opening spaced axially apart from the opening stated above when the piston of the second piston device adopts the bottom dead center. In addition to the cross scavenging, a uniflow scavenging of the combustion chamber may also be carried out, depending on load.

A free piston apparatus in which a cross, uniflow, and loop scavenging of the combustion chamber may be carried out is described in DE 10 2008 053 068 A1.

SUMMARY

An object of the present disclosure is to provide a free piston apparatus of the kind stated at the outset and a method for operating such a free piston apparatus, in which an operating point of the free piston apparatus is versatilely adjustable.

In a first aspect of the present disclosure, a free piston apparatus, comprises a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controllable by means of a control device. The piston is movable at least partially over the at least one first opening, and the bottom dead center of the piston is adjustable such that when the piston adopts the bottom dead center, the at least one first opening is partially unblocked and partially blocked for adjusting a free cross sectional area of the at least one first opening, and/or an opening duration is adjustable during which the piston at least partially unblocks the at least one first opening upon passing through the bottom dead center, also in the case of maintaining the position of the bottom dead center.

In a second aspect of the present disclosure, a method for operating a free piston apparatus is provided, the apparatus comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controlled by means of a control device. The piston is moved at least partially over the at least one first opening, and the bottom dead center of the piston is adjusted such that when the piston adopts the bottom dead center, the at least one first opening is partially unblocked and partially blocked for adjusting a free cross sectional area of the at least one first opening, and/or an opening duration is adjusted during which the piston at least partially unblocks the at least one first opening upon passing through the bottom dead center, also in the case of maintaining the bottom dead center.

BRIEF DESCRIPTION OF THE DRAWING FIGURES

Figure 2:
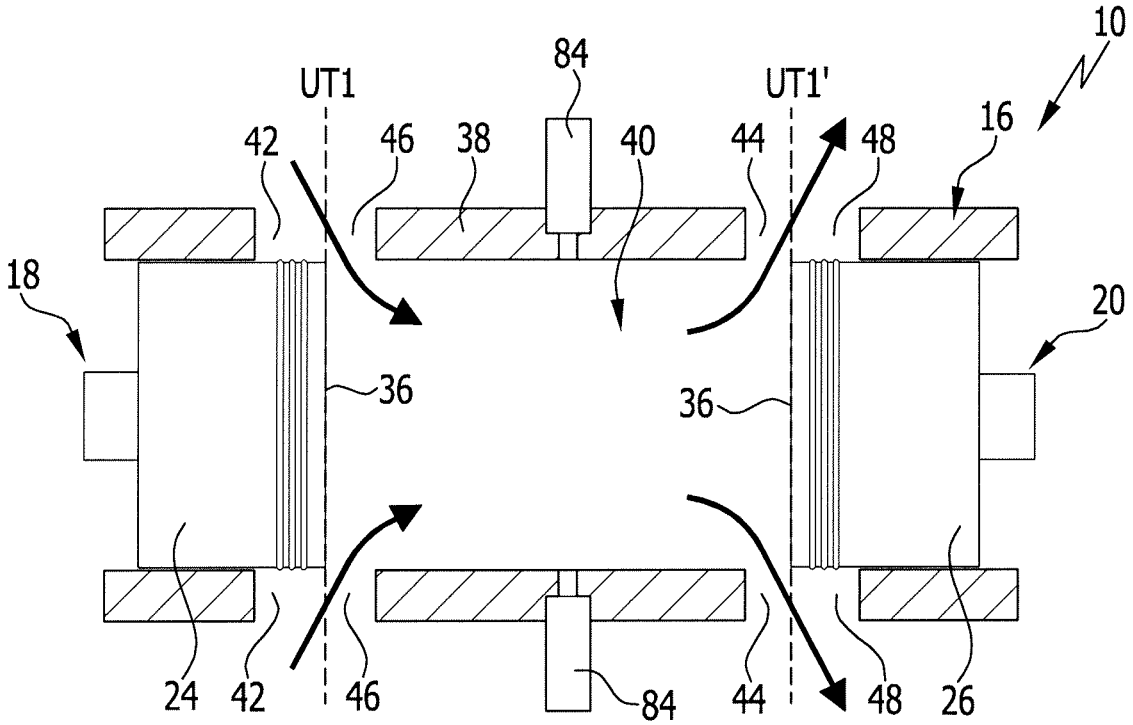
Figure 3:
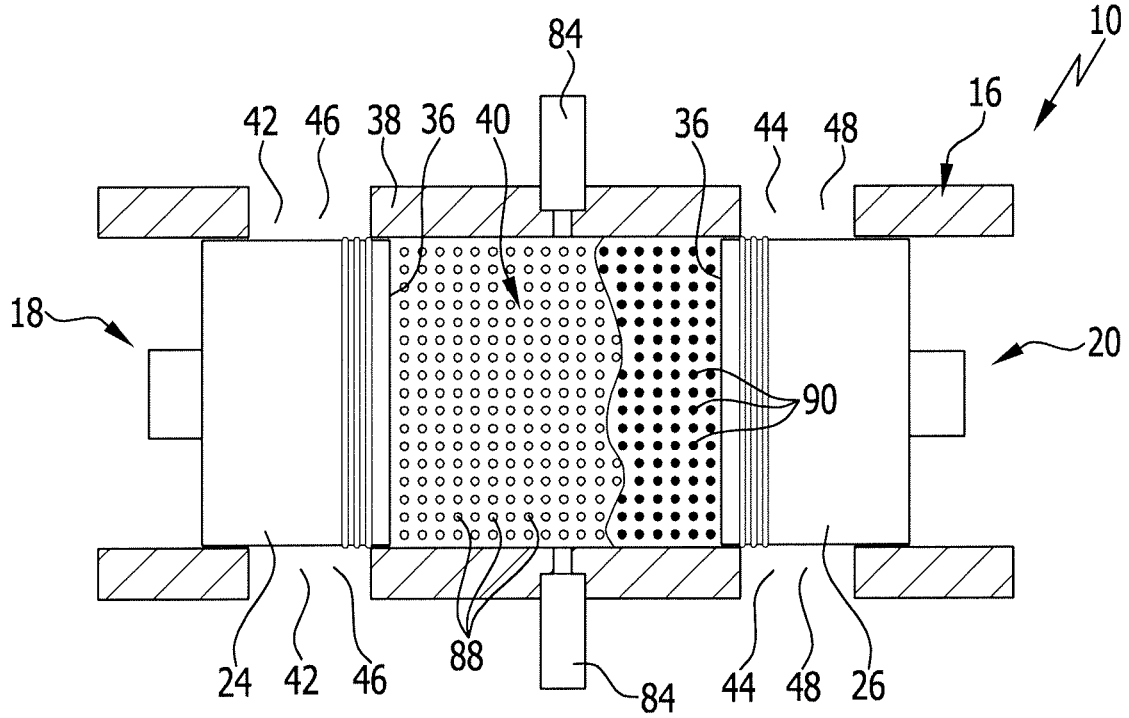
Figure 4:
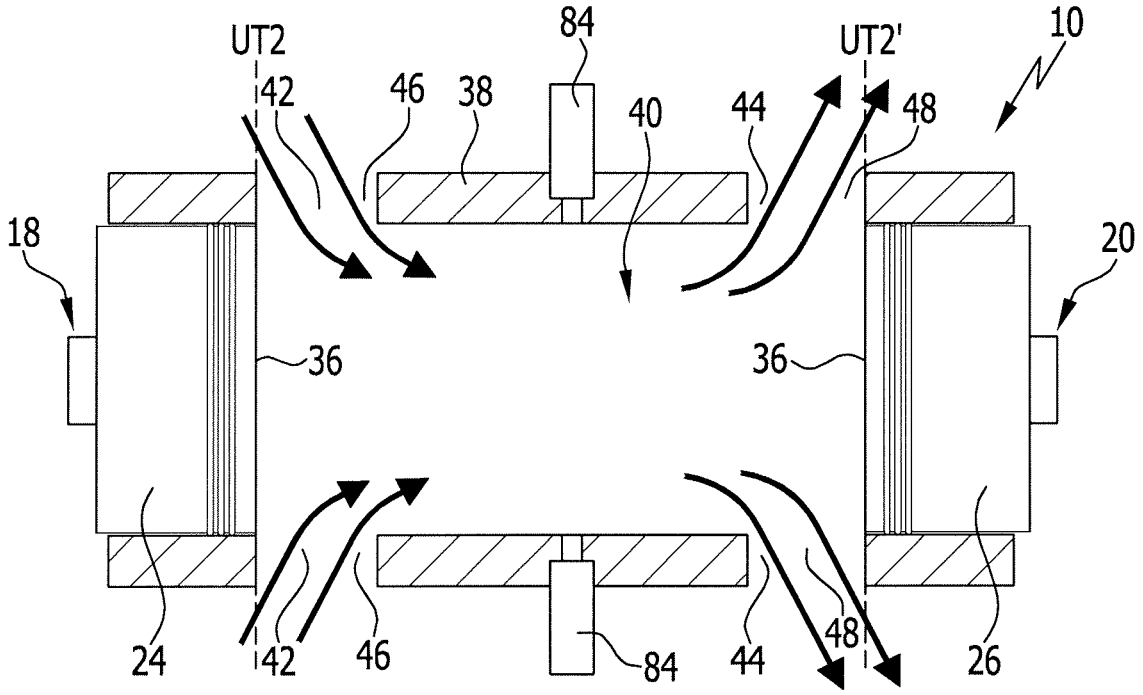
Figure 5:
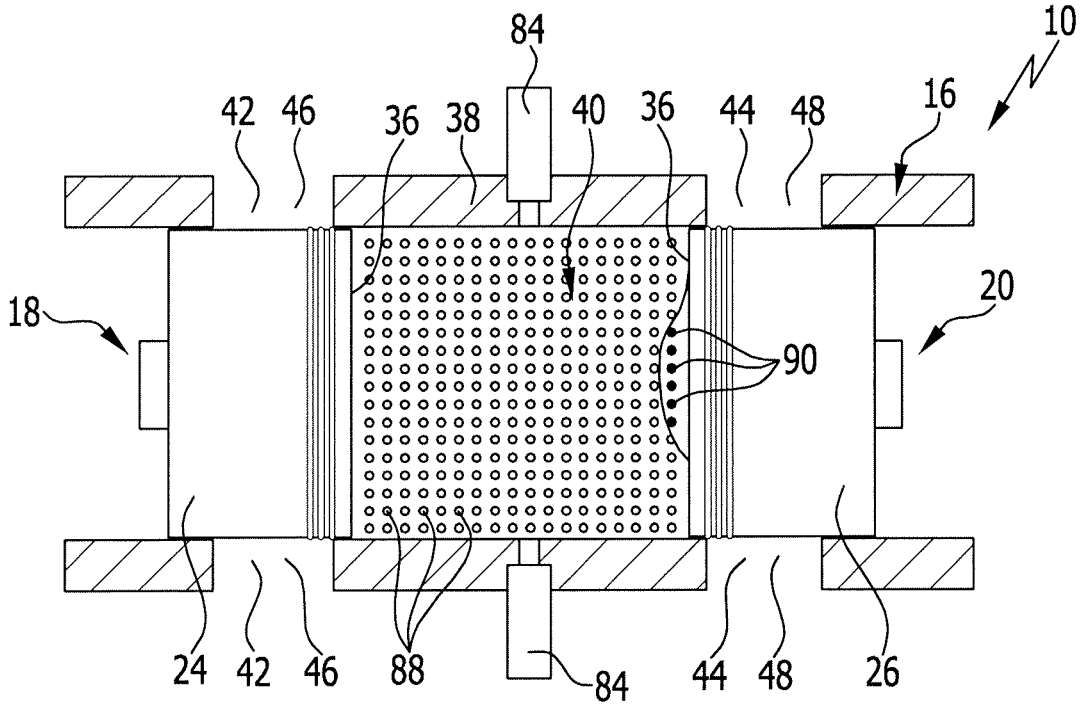
Figure 6:
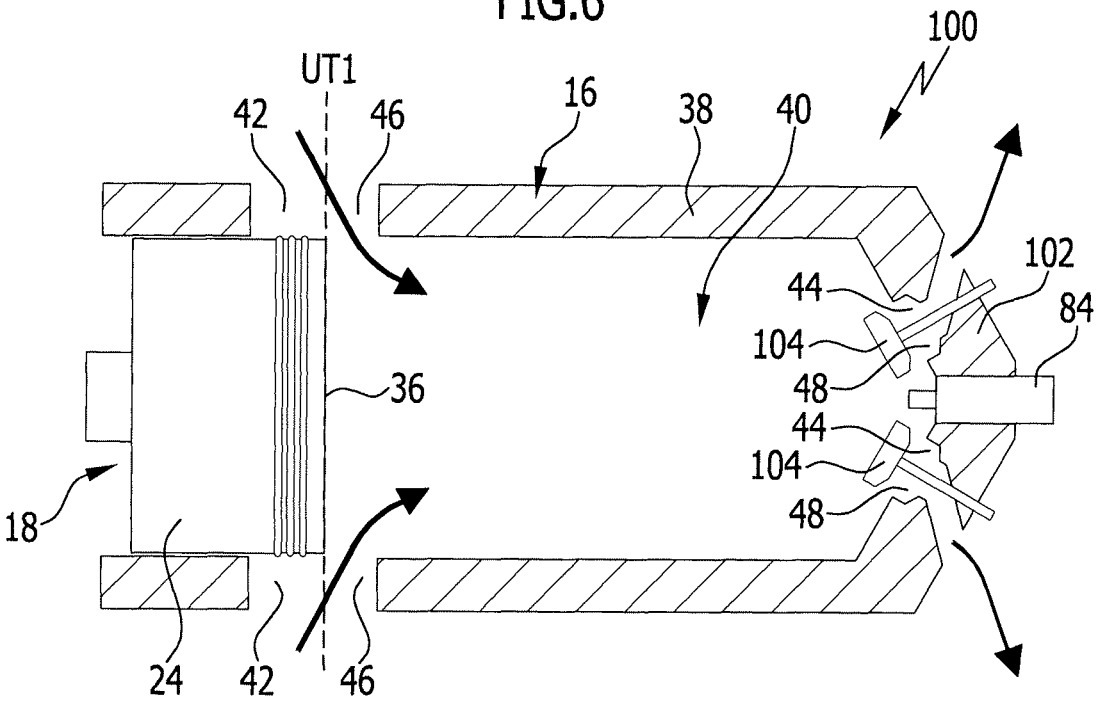
Figure 7:
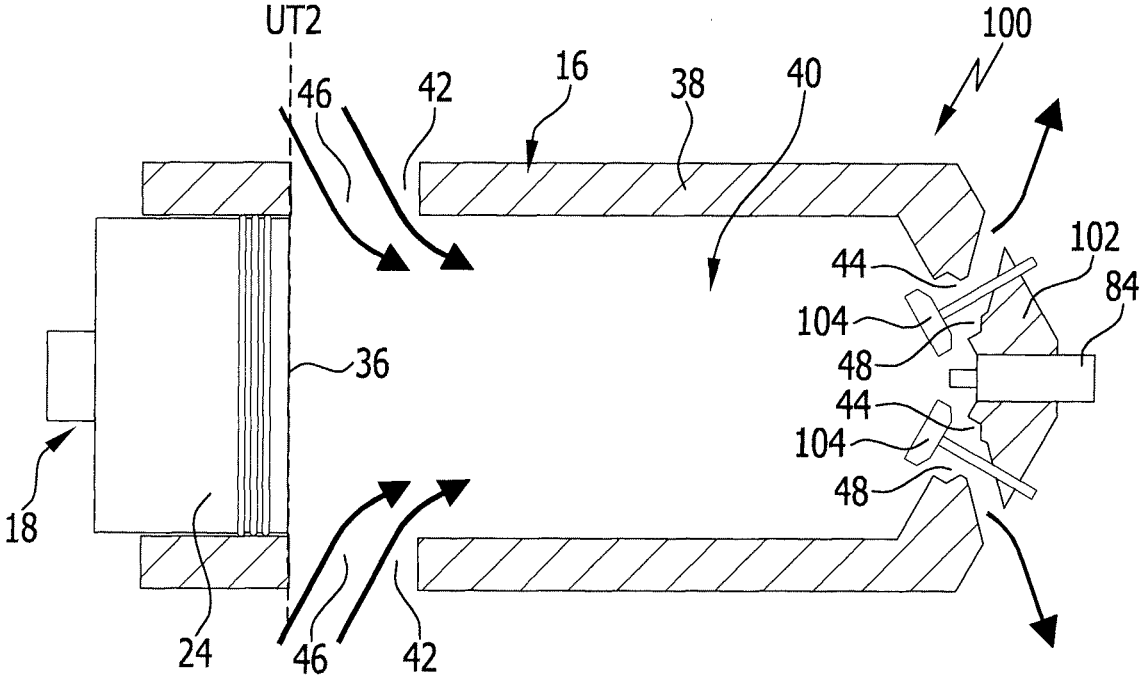
Figure 8:
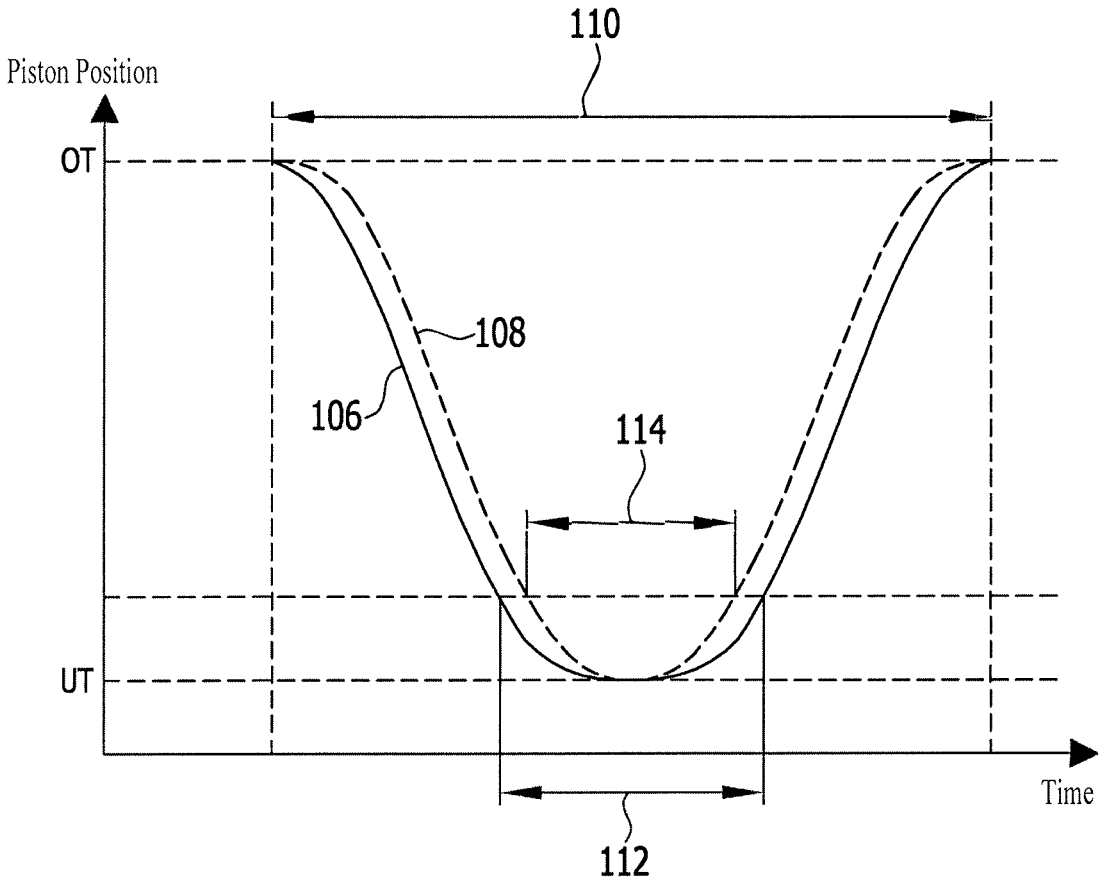

The foregoing summary and the following description may be better understood in conjunction with the drawing figures. The subsequently described free piston apparatuses in accordance with the present disclosure allow for the execution of the method in accordance with the present disclosure. In the drawings:

FIG. 1: shows a schematic depiction of a free piston apparatus in accordance with the present disclosure;

FIG. 2: shows an enlarged depiction of detail A in FIG. 1, wherein two pistons of the free piston apparatus adopt a respective bottom dead center;

FIG. 3: shows a depiction corresponding to FIG. 2, wherein the pistons are in the upward movement;

FIG. 4: shows a depiction corresponding to FIG. 2, wherein the free piston apparatus has a different operating point and the pistons adopt a different bottom dead center;

FIG. 5: shows a depiction corresponding to FIG. 4, wherein the pistons are in the upward movement;

FIG. 6: shows a partial depiction of a further preferred embodiment of a free piston apparatus, the piston of which adopts a bottom dead center;

FIG. 7: shows a depiction corresponding to FIG. 6, wherein the free piston apparatus is operated with a different operating point and the piston adopt a different bottom dead center; and FIG. 8: schematically shows a piston position depending on the time for a free piston apparatus in accordance with the present disclosure which is operated with two different operating points in which different times for the charge exchange are achieved.

DETAILED DESCRIPTION

Although the present disclosure is illustrated and described herein with reference to specific embodiments, the present disclosure is not intended to be limited to the details shown. Rather, various modifications may be made in the details within the scope and range of equivalents of the claims and without departing from the present disclosure.

The present disclosure relates to a free piston apparatus, comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controllable by means of a control device. The piston is movable at least partially over the at least one first opening, and the bottom dead center of the piston is adjustable such that when the piston adopts the bottom dead center, the at least one first opening is partially unblocked and partially blocked for adjusting a free cross sectional area of the at least one first opening, and/or an opening duration is adjustable during which the piston at least partially unblocks the at least one first opening upon passing through the bottom dead center, also in the case of maintaining the position of the bottom dead center.

In the free piston apparatus in accordance with the present disclosure, there is the possibility of influencing the scavenging operation for the combustion chamber during the charge exchange. The amount of fresh gas suppliable or exhaust gas removable via the at least one first opening may be adjusted by way of the control of the movement of the piston device by the control device in the operation of the free piston apparatus. In contrast to the prior art stated at the outset, it is not necessary to provide additional openings on the piston receptacle for different scavenging channels. Instead, in the present disclosure, the adjustment of the amount of fresh gas and exhaust gas may occur in a constructively simple manner in that the bottom dead center of the piston is selected such that the at least one first opening is partially unblocked for unblocking a desired opening cross section and is otherwise partially blocked. Depending on a size of the free cross sectional area, more or less fresh gas and exhaust gas, respectively, may flow through the at least one first opening. This may be achieved in accordance with the present disclosure alternatively or in addition also in that the movement of the piston device in operation is controlled such that the opening duration is adjusted during which the at least one first opening is entirely or at least partially unblocked, wherein the position of the bottom dead center of the piston relative to the piston receptacle itself is not varied. The time may thus be adjusted which the piston requires for passing through the bottom dead center and the duration thereby influenced during which fresh gas is able to flow into the combustion chamber and exhaust gas be removed from the combustion chamber, respectively.

The solution in accordance with the present disclosure allows for influencing the scavenging operation for the combustion chamber, whereby a versatile operation of the free piston apparatus is possible. For example, the ratio of fresh gas and exhaust gas may be adjusted with respect to an optimized combustion. Thus, in an advantageous embodiment, it is possible, for example, to switch from an operation with low residual gas amount (a lot of fresh gas and little exhaust gas) with spark ignition to an operation with high residual gas amount (smaller amount of fresh gas and higher proportion of exhaust gas) with auto-ignition. This is preferably possible individual to a cycle, for each cycle of the piston device. While in a first cycle for spark ignition, for example, a smaller residual gas amount (about 5% or less) remains in the combustion chamber, upon the piston passing through the bottom dead center, the charge exchange may be carried out for the subsequent cycle such that a comparatively high residual gas amount (about 50%) is provided, so that an auto-ignition immediately thereafter is possible, and vice versa. Operating points at which neither a small residual gas amount (about less than 5%) nor a high residual gas amount is present and which are energetically unfavorable may be avoided.

By adjusting the opening duration of the at least one opening, the charge pressure and thus also the temperature in the combustion chamber may be controlled, e.g., with constant frequency of the free piston apparatus. Flow conditions in the combustion chamber like turbulence, twist, and tumble, for example with equal filling of the combustion chamber, may preferably be controlled by way of the charge pressure.

In the present disclosure, it is possible to control the time of the charge exchange—by way of the opening duration of the at least one inlet opening or outlet opening and/or by way of the unblockable cross sectional area. The charge exchange may thereby be adjusted depending of the frequency of the free piston apparatus, on the desired charge pressure, on the residual gas amount, on the ignition variant (spark or auto-ignition), the desired load and/or on the flow condition (turbulence, twist, tumble . . . ).

In the scope of the present disclosure, "controlling" or "control" is to be interpreted to the effect that "regulation" and "regulating", respectively, is thereby meant alternatively or in addition. "Controlling" is thus presently to be interpreted as "controlling and/or regulating".

"Fresh gas" is presently to be understood as a gas or gas mixture (in particular air) for the internal combustion in the combustion chamber, wherein a fuel may also be admixed to the gas or gas mixture. "Fresh gas" may therefore presently also refer to a gas-fuel-mixture which may flow into the combustion chamber via the at least one entry opening. "Exhaust gas" presently refers to a combustion product of the internal combustion.

It is understood that a supply conduit for fresh gas and a discharge conduit for exhaust gas, respectively, is connected and connectable, respectively, to the at least one inlet opening and the at least one outlet opening.

The at least one first opening and the at least one second opening in the wall arrangement are, e.g., of slit-shaped configuration.

More than one first opening may be provided, for example a multitude of first openings which are formed in the wall arrangement in circumferential direction of an axis of the piston device. The same applies to the second opening, of which a multitude may be present.

Provision may advantageously be made for the at least one first opening to be entirely unblockable upon the piston adopting the bottom dead center. As a result, the amount of fresh gas being supplied and exhaust gas being removed, respectively, may be maximized.

The at least one inlet opening, along the movement direction of the piston device, is preferably spaced apart from each outlet opening. That may presently be understood in that, transverse to the movement direction of the piston device, no outlet opening is located opposite a respective inlet opening and thus no cross scavenging of the combustion chamber is carried out. Instead, only a uniflow scavenging occurs by way of the inlet and outlet openings, respectively, spaced apart from each other along the movement direction.

The free piston apparatus preferably comprises an energy coupling device which is coupled to the control device, wherein the movement of the at least one piston device is controllable by the control device by way of energy coupling device. The control device may control the energy coupling device to control the movement of the piston device. For this purpose, it is preferred if the energy coupling device comprises in particular a linear generator. The linear generator may comprise a rotor arrangement fixed on the piston device and a stator arrangement fixed on the piston receptacle. Rotor arrangement and stator arrangement comprise in particular magnets and coils, respectively.

It is advantageous if the free piston device comprises a spring-back device for the at least one piston device, which is coupled to the control device. The spring-back device is preferably controllable by the control device to control the movement of the at least one piston device. The spring-back device is or comprises in particular a gas spring. The rigidity of the gas spring may, also in operation, be adjusted by means of the control device, preferably through the supply of gas or the removal of gas. Alternatively or in addition, a mechanical spring-back device may be provided as a spring-back device.

In an advantageous implementation of the free piston apparatus, the at least one first opening is an inlet opening and the at least one second opening an outlet opening.

In an advantageous implementation of a different kind, provision may be made for the at least one first opening to be an outlet opening and the at least one second opening an inlet opening.

An advantageous embodiment of the piston device provides (exactly) one piston device, wherein at the at least one second opening is arranged at least one valve which is controllable by the control device for unblocking or blocking the at least one second opening. The piston of the one piston device at least partially unblocks the at least one first opening at the bottom dead center and/or the opening duration of the at least one first opening is adjustable as described at the outset. By way of the at least one valve at the second opening, the at least one second opening may be unblocked by way of the control device and the charge exchange thereby carried out. The at least one second opening is arranged on the wall arrangement of the combustion chamber for example on the face side and is opposite a piston face of the piston.

In an advantageous embodiment of a different kind, it is favorable if the free piston apparatus comprises a further piston device having a piston, which piston device is arranged so as to be linearly reciprocable in the piston receptacle, wherein the pistons of both piston devices are positioned in opposed piston arrangement and the combustion chamber is formed between the pistons. By way of the opposed piston arrangement, a compensation of the moved masses and moments may preferably be achieved. The piston devices thereby oscillate opposite to each other in the piston receptacle.

The piston of the further piston device is preferably movable at least partially over at least one further opening of the wall arrangement, and the amount of exhaust gas removable or fresh gas suppliable via the at least one further opening is controllable by way of the movement of the further piston device in the operation of the control device. In corresponding manner as in the region of the at least one first opening, in the present embodiment, influence may be exerted on the scavenging operation and the charge exchange. The amount of exhaust gas removed or fresh gas supplied via the at least one further opening may be influenced by the control device controlling the movement also of the second piston device.

The at least one further opening is in particular and advantageously the at least one second opening. The control of the movements of the piston devices may occur in such a way that, by way of a respective piston, the amount of fresh gas via the at least one first and exhaust gas via the at least on second opening, respectively, is adjustable in the operation of the free piston apparatus.

In an embodiment of a different kind, provision may be made for the at least one further opening to be at least one first opening, wherein the at least one second opening, along the movement direction of the piston devices, is positioned between the first openings. Provided at the at least one second opening is, for example, a valve which is controllable by the control device.

The bottom dead center of the piston of the further piston device is advantageously adjustable such that the at least one further opening, upon the piston adopting the bottom dead center, is partially unblocked and partially blocked for adjusting a free cross sectional area of the at least one further opening. As a result, the amount of suppliable fresh gas or removable exhaust gas may be adjusted, as in the free piston apparatus in accordance with the present disclosure.

Alternatively or in addition, an opening duration is adjustable during which the piston of the further piston device at least partially unblocks the at least one further opening upon passing through the bottom dead center, also in the case of maintaining the position of the bottom dead center. The movement of the further piston device may be controlled in such a way that the time for passing through the bottom dead center of the further piston may be adjusted to the effect of adjusting the amount of suppliable fresh gas or removable exhaust gas.

Favorably, an equal stroke of both piston devices is adjustable.

The movement of both piston devices is preferably controllable antisymmetrical to each other.

The free piston apparatus preferably comprises a spring-back device for the further piston device.

As mentioned, the movement of the further piston device may also be controlled. For this purpose, a spring-back device and/or energy coupling device coupled to the control device is/are associated with the at least one further piston device, wherein the movement of the at least one further piston device is controllable by way of the spring-back device and/or the energy coupling device, wherein the energy coupling device preferably comprises a linear generator. The free piston apparatus may comprise a spring-back device and/or an energy coupling device for controlling a respective piston device.

It proves to be advantageous if the at least one first opening and the at least one second opening are arranged or configured on the piston receptacle symmetrical to each other. This is in particular advantageous in the case of equal stroke and antisymmetrical movement of the piston devices to each other.

As mentioned at the outset, the present disclosure also relates to a method for operating a free piston apparatus, comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controlled by means of a control device.

In a method of that kind, the object stated at the outset is achieved in accordance with the present disclosure in that the piston is moved at least partially over the at least one first opening, and in that the bottom dead center of the piston is adjusted such that when the piston adopts the bottom dead center, the at least one first opening is partially unblocked and partially blocked for adjusting a free cross sectional area of the at least one first opening and/or in that an opening duration is adjusted during which the piston at least partially unblocks the at least one first opening upon passing through the bottom dead center, also in the case of maintaining the bottom dead center.

The advantages which were mentioned in conjunction with the explanation of the free piston apparatus in accordance with the present disclosure may be achieved by executing the method. In order to avoid repetition, reference may thus be made to the preceding descriptions.

In particular, advantageous embodiments of the method in accordance with the present disclosure result from advantageous embodiments of the apparatus in accordance with the present disclosure. Reference may be made to the preceding remarks also in this regard.

In particular, the method in accordance with the present disclosure allows for adjusting the scavenging operation and thus the charge exchange in the operation of the free piston apparatus. The charge pressure and thus the temperature in the combustion chamber is adjustable. The flow conditions like turbulence, twist, and tumble may be controlled. A transition from an operation with spark ignition in the case of low residual gas amount to an operation with auto-ignition in the case of high residual gas amount and vice versa is preferably performable individual to a cycle.

FIG. 1 shows an advantageous embodiment of a free piston apparatus in accordance with the present disclosure, which is applied with the reference numeral 10, which in particular forms a free piston motor 12.

The free piston apparatus 10 comprises a piston receptacle 16 forming a housing 14. Two piston devices 18, 20 are arranged in the piston receptacle 16 so as to be linearly reciprocable along a common axis 22 defined by said piston devices 18, 20. A respective piston device 18, 20 comprises a piston 24 and 26, respectively, a piston rod 28 and 30, respectively, and an opposed piston 32 and 34, respectively. The piston devices 18, 20 and thus the pistons 24, 26 are positioned in opposed piston arrangement, wherein piston faces 36 of the pistons 24, 26 are facing each other.

The piston receptacle 16 comprises a combustion chamber 40 delimited by a wall arrangement 38 of the housing 14. The combustion chamber 40 is variable in size as a result of the opposing movement of the piston devices 18, 20 and is formed between the piston faces 36.

First openings 42 and second openings 44 are formed in the wall arrangement 38. Presently, in each case two first and two second openings 42, 44, respectively, are present, wherein the number may also be different, however. The openings 42, 44 are configured, e.g., as slits in the wall arrangement 38.

The first openings 42 are inlet openings 46. By way of the inlet openings 46, fresh gas is able to flow into the combustion chamber 40 upon the charge exchange. Inlet conduits, which are not depicted in the drawing and by way of which the inlet openings 46 open into the combustion chamber 40, may be connected to the wall arrangement 38.

The second openings 44 are outlet openings 48. By way of the outlet openings 48, exhaust gas is able to be removed from the combustion chamber 40 upon the charge exchange. At the outlet openings 48, outlet conduits not shown in the drawing may be connected to the wall arrangement 38, wherein the combustion chamber 40 opens into the outlet conduits via the outlet openings 48.

The inlet openings 46 are arranged on the piston receptacle 16 symmetrical to the outlet openings 48 and may preferably be of identical configuration thereto.

The inlet openings 46 are associated with the piston device 18 and in particular the piston 24 thereof. The piston 24 forms a valve body for closing and unblocking the inlet openings 46. Depending on the stroke and course of the movement of the piston device 18, the piston 24 entirely or partially unblocks the inlet openings at the bottom dead center and the opening duration of the inlet openings 46 may be adjusted.

The outlet openings 48 are associated with the piston device 20 and in particular its piston 26. The piston 26 forms a valve body for closing and unblocking the outlet openings 48. Depending on the stroke and course of the movement of the piston device 20, the piston 26 entirely or partially unblocks the outlet openings and the opening duration of the inlet outlet openings 48 may be adjusted.

The piston devices 18, 20 are favorably of identical configuration.

The free piston apparatus 10 has associated with the piston device 18 a spring-back device 50 which is preferably configured as a gas spring 52. A spring-back space 54 with gas accommodated therein is formed in the piston receptacle 16. Upon a combustion in the combustion chamber 40, the piston device 18 moves under compression of the gas in the spring-back space 54. Upon the expansion of the gas, the piston device 18 is moved in the opposite direction.

In a corresponding manner, a spring-back device 56, configured as a gas spring 58, is provided for the piston device 20, with a spring-back space 60 formed in the piston receptacle 16.

The free piston apparatus 10 has an energy coupling device 62 associated with the piston device 18, presently configured as a linear generator 64. The linear generator 64 comprises a rotor arrangement 66 on the piston rod 28 and a stator arrangement 68 on the piston receptacle 16.

In a corresponding manner, the free piston apparatus 10 comprises, associated with the piston device 20, an energy coupling device 70 configured as a linear generator 72. The linear generator 72 comprises a rotor arrangement 74 on the piston rod 30 and a stator arrangement 76 on the piston receptacle 16.

The free piston apparatus 10 has a control device 78. The control device 78 is, schematically depicted via control lines 79 and 80, coupled to the spring-back device 50 and the spring-back device 56, respectively. The spring force of the gas springs 52, 58 may preferably be adjusted by means of the control device 78 for controlling the movement of the piston device 18, 20 in operation.

Alternatively or in addition, the movement of the piston devices 18, 20 may be controlled independently of each other by controlling the linear generators 64 and 72, respectively. Control lines 81 and 82 schematically show the coupling of the control device 78 to the linear generators 64 and 72, respectively.

As already mentioned, "controlling" presently also comprises "regulating".

At the combustion chamber 40 may be arranged an ignition device 84 which is controllable by the control device 78 by way of a control line 86. Likewise, at the combustion chamber 40 may be arranged an injection device not shown in the drawing, likewise controllable by the control device 78. A fuel may be introduced into the combustion chamber 40 by way of the injection device.

Alternatively or in addition to the injection device, provision is made in the free piston apparatus 10 that the "fresh gas" suppliable via the inlet openings 46 may be a gas-fuel-mixture of gas or gas mixture with admixed fuel.

The free piston apparatus 10 is operated in two stroke operation in which the piston devices 18, 20 are moved asymmetrically to each other. The gas-fuel-mixture condensed in the combustion chamber 40 is ignited by means of the ignition device 84 or by auto-ignition, whereby the piston devices 18, 20 are driven apart from each other. The inlet openings 46 and the outlet openings 48 are hereby at least partially unblocked as subsequently described. A uniflow scavenging of the combustion chamber 40 occurs (FIGS. 2 and 4), with fresh gas entering through the inlet opening 46 and exhaust gas removed through the outlet opening 48. By way of the upward movement of the pistons 24, 26 due to the gas springs 52, 58, the fuel mixture is condensed for undergoing the subsequent cycle.

Both pistons 24, 26 pass through a respective top dead center OT and a respective bottom dead center UT.

In accordance with the present disclosure, provision is made in the free piston apparatus 10 for the amount of fresh gas that is able to flow into the combustion chamber 40 via the inlet openings 46 upon the charge exchange to be controllable by way of the movement of the piston device 18, and/or the amount of exhaust gas that is able to flow out of the combustion chamber 40 via the outlet openings 48 upon the charge exchange.

This occurs in particular in that the piston 24 acts as a valve body for the inlet openings 46 and is movable at least partially over the same. The control device 78 may adjust the movement of the piston device 18 for adopting a predeterminable bottom dead center UT. This is shown for example in FIG. 2, wherein the position of the bottom dead center is designated as UT1.

If the piston 24 adopts the bottom dead center UT1, then the inlet openings 46 in the example of FIG. 2 are partially opened and partially blocked by the piston 24. By controlling the movement of the piston device 18, the free cross sectional area may thus be adjusted for controlling the amount of fresh gas inflowing upon the charge exchange.

The movement of the piston device 20 in the free piston apparatus 10 may advantageously be controlled in a corresponding manner, such that the outlet openings 48 are entirely or partially unblockable by the piston 26. Using the example of FIG. 2, it is depicted that the piston 26, which also forms a valve body for the outlet openings 48, adopts a bottom dead center UT1'. The outlet openings 48 are hereby partially unblocked and otherwise blocked by the piston 26.

Thus also in the piston device 20, the movement may be controlled in such a way that the free cross sectional area of the outlet openings 48 is adjusted in order to control the amount of removed exhaust gas upon the charge exchange and scavenging operation.

FIG. 4 shows for example how the movements of the piston devices 18, 20 are controllable in a different way to adopt a different operating point of the free piston apparatus 10. The movement of the piston device 18 is hereby controlled such that the piston 24 thereof entirely unblocks the inlet openings 46 upon adopting the bottom dead center UT2. The amount of fresh gas inflowing upon the charge exchange is greater than in the example shown in FIG. 2, because the free cross sectional area of the inlet openings 46 is greater and in particular maximized.

In a corresponding manner, the movement of the piston device 20 is controlled such that the outlet openings 48 are then entirely unblocked when the piston 26 adopts the bottom dead center UT2'. Due to the greater cross sectional area than in the example shown in FIG. 2, the amount of removed exhaust gas upon the charge exchange is greater than when the piston 26 adopts the bottom dead center UT1' as described above.

FIGS. 3 and 5 schematically show how different residual gas contents are present upon the upward movement of the pistons 24, 26 after the scavenging operation in the combustion chamber 40. Fresh gas is depicted in FIGS. 3 and 5 by open circles 88 and residual gas by black dots 90. Because the inlet openings 46 and 48 are only partially open upon the charge exchange in the example of FIG. 2, the content of residual gas in the combustion chamber 40 is greater than in the example of FIG. 4 in which the inlet openings 46 and 48 are entirely open.

By way of the present disclosure, there is the possibility of varying the residual gas content in the combustion chamber 40 during operation of the free piston apparatus 10 and in particular individual to a cycle. For example, it is possible to switch from a relatively high residual gas amount (FIGS. 2 and 3) with auto-ignition operation to an operation with relatively low residual gas amount (FIGS. 4 and 5) with spark ignition by way of the ignition device 84, and vice versa.

By way of the scavenging operation, the charge pressure in the combustion chamber 40, thus its temperature and the flow conditions in the combustion chamber 40 due to the charge pressure, like turbulence, twist, or tumble, may be varied.

FIGS. 6 and 7 show a partial depiction of a further free piston apparatus in accordance with the present disclosure, applied with the reference numeral 100. Identical reference numerals are used for like or functionally equivalent features and components of the free piston apparatuses 10, 100. The free piston apparatus 100 differs from the free piston apparatus 10 in that only one piston device 18 is provided. The wall arrangement 38 is closed on the side of the piston 24 opposite the piston face 36 and has a face wall 102 in this region. The outlet openings 48 are presently formed in the face wall 102. A valve 104 which is controllable by the control device 78 is associated with the respective outlet opening 48.

FIGS. 6 and 7 do not show the spring-back device 50 and the energy coupling device 62, but these are also provided in the free piston apparatus 100.

In the free piston apparatus 100, the position of the bottom dead center of the piston 24 may likewise by adjusted in operation, such that the amount of inflowing fresh gas is controlled. The valves 104 are open during the charge exchange so that exhaust gas is able to be removed from the combustion chamber 40. The situation of FIG. 6 hereby corresponds to the example of FIG. 2 and the situation of FIG. 7 to the example of FIG. 4. In both situations, however, the outlet openings 48 are completely unblocked by way of the valves 104, and only the amount of inflowing fresh gas is varied by way of the position of the respective bottom dead center UT1 and UT2, respectively, of the piston 24. However, the possibility is also given to vary the residual gas content in the combustion chamber 40.

In the scope of the present disclosure, it is also possible to adjust an opening duration by way of the movement of a piston device, for which opening duration the inlet openings 46 or the outlet openings 48 are opened, wherein the position of a bottom dead center of the piston is not changed.

This is possible both in the case of the free piston apparatus 10 and the free piston apparatus 100, and it is explained using FIG. 8 in which a first trajectory 106 for a piston is depicted with a solid line and a second trajectory 108 for the same piston is depicted with a dashed line. The piston is, e.g., the piston 24 of the piston device 18, though it could also be concerning the piston 26 of the piston device 20. The trajectories 106 and 108 show the piston position relative to the piston receptacle depending on the time.

Upon the movement of the piston, at least the position of the bottom dead center is maintained and not varied, wherein in the example of FIG. 8, also the top dead center is identical for both trajectories 106, 108. Further, in both trajectories 106, 108, an identical frequency is traveled, recognizable by an identical period duration 110.

As long as the piston is located between the position 112 and the bottom dead center, the corresponding inlet opening 46 or outlet opening 48 is unblocked. However, the time for passing through the bottom dead center with unblocked openings is different for both trajectories 106, 108. This time duration 112 for the trajectory 106 is greater than the corresponding time duration 114 for the trajectory 108. For this reason, the piston passes through the bottom dead center faster upon adopting the trajectory 108, and the openings are open less long than if the piston travels trajectory 106.

It is also thereby possible to control the amount of inflowing fresh gas or removed exhaust gas by way of the movement of the piston device.

REFERENCE NUMERALS

10 free piston apparatus
12 free piston motor
14 housing
16 piston receptacle
18 piston device
20 piston device
22 axis
24 piston
26 piston
28 piston rod
30 piston rod
32 opposed piston
34 opposed piston
36 piston face
38 wall arrangement
40 combustion chamber
42 first opening
44 second opening
46 inlet opening
48 outlet opening
50 spring-back device
52 gas spring
54 spring-back space
56 spring-back device
58 gas spring
60 spring-back space
62 energy coupling device
64 linear generator
66 rotor arrangement
68 stator arrangement
70 energy coupling device
72 linear generator
74 rotor arrangement
76 stator arrangement
78 control device
79 control line
80 control line
81 control line
82 control line
84 ignition device
86 control line
88 open circle
90 dot
100 free piston apparatus
102 face wall
104 valve
106 trajectory
108 trajectory
110 period duration
112 time duration
114 time duration

The invention claimed is:

1. A free piston apparatus comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, the movement of the at least one piston device being controllable by a control device and the piston being movable at least partially over the at least one first opening for adjusting the bottom dead center of the piston such that, when the piston adopts the bottom dead center, the at least one first opening is partially unblocked and partially blocked for adjusting a free cross sectional area of the at least one first opening, wherein the free piston apparatus comprises a further piston device having a piston, which piston device is arranged so as to be linearly reciprocable in the piston receptacle, wherein the pistons of both piston devices are positioned in opposed piston arrangement and the combustion chamber is formed between the pistons, wherein the piston of the further piston device is movable at least partially over at least one further opening of the wall arrangement, and wherein the amount of exhaust gas removable or fresh gas suppliable via the at least one further opening is adjustable by way of the movement of the further piston device in the operation of the control device, and wherein the movement of the further piston device is controllable for adjusting the bottom dead center of the piston of the further piston device such that when the piston adopts the bottom dead center, the at least one further opening is partially unblocked and partially blocked for adjusting a free cross sectional area of the at least one further opening.

2. The free piston apparatus according to claim 1, wherein the at least one first opening is entirely unblockable upon the piston adopting the bottom dead center.

3. The free piston apparatus according to claim 1, wherein the at least one inlet opening, along the movement direction of the piston device, is spaced apart from each outlet opening.

4. The free piston apparatus according to claim 1, wherein the free piston apparatus comprises an energy coupling device which is coupled to the control device, and in that the movement of the at least one piston device is controllable by the control device by way of the energy coupling device.

5. The free piston apparatus according to claim 4, wherein the energy coupling device comprises a linear generator.

6. The free piston apparatus according to claim 1, wherein the free piston apparatus comprises a spring-back device, which is coupled to the control device, for the at least one piston device, and wherein the spring-back device is controllable by the control device for controlling the movement of the at least one piston device.

7. The free piston apparatus according to claim 1, wherein the at least one first opening is an inlet opening and the at least one second opening an outlet opening.

8. The free piston apparatus according to claim 1, wherein a piston device is provided, wherein at the at least one second opening is arranged at least one valve which is controllable by a control device for unblocking or blocking the at least one second opening.

9. The free piston apparatus according to claim 1, wherein the at least one further opening is the at least one second opening.

10. The free piston apparatus according to claim 1, wherein the at least one further opening is at least one first opening, wherein the at least one second opening, along the movement direction of the piston devices, is positioned between the first openings.

11. The free piston apparatus according to claim 1, wherein an equal stroke of both piston devices is adjustable.

12. The free piston apparatus according to claim 1, wherein the movement of both piston devices is controllable asymmetrically to each other.

13. The free piston apparatus according to claim 1, wherein at least one of a spring-back device and an energy coupling device coupled to the control device is associated with the at least one further piston device, wherein the movement of the at least one further piston device is controllable by way of at least one of the spring-back device and the energy coupling device.

14. The free piston apparatus according to claim 13, wherein the energy coupling device comprises a linear generator.

15. The free piston apparatus according to claim 1, wherein the at least one first opening and the at least one second opening are arranged or configured on the piston receptacle symmetrical to each other.

16. A method for operating a free piston apparatus, comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controllable by a control device, wherein the piston is moved at least partially over the at least one first opening, and wherein the bottom dead center of the piston is adjusted such that when the piston adopts the bottom dead center, the at least one first opening is partially unblocked and partially blocked for adjusting a free cross sectional area of the at least one first opening, wherein the free piston apparatus comprises a further piston device having a piston, which piston device is arranged so as to be linearly reciprocable in the piston receptacle, wherein the pistons of both piston devices are positioned in opposed piston arrangement and the combustion chamber is formed between the pistons, wherein the piston of the further piston device is movable at least partially over at least one further opening of the wall arrangement, and wherein the amount of exhaust gas removable or fresh gas suppliable via the at least one further opening is adjustable by way of the movement of the further piston device in the operation of the control device, and wherein the movement of the further piston device is controllable for adjusting the bottom dead center of the piston of the further piston device such that when the piston adopts the bottom dead center, the at least one further opening is partially unblocked and partially blocked for adjusting a free cross sectional area of the at least one further opening.

17. A free piston apparatus comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, the movement of the at least one piston device being controllable by a control device and the piston being movable at least partially over the at least one first opening for adjusting an opening duration during which the piston at least partially unblocks the at least one first opening upon passing through the bottom dead center, also in the case of maintaining the position of the bottom dead center.

18. A method for operating a free piston apparatus, comprising a piston receptacle in which at least one piston device having a piston is arranged so as to be linearly reciprocable, wherein the piston receptacle comprises or forms a combustion chamber delimited by a wall arrangement in which at least one first opening and at least one second opening are formed, which openings comprise at least one inlet opening for the supply of fresh gas and, spaced apart therefrom in movement direction of the piston device, at least one outlet opening for the removal of exhaust gas for a uniflow scavenging of the combustion chamber, wherein the movement of the at least one piston device is controllable by a control device, wherein the piston is moved at least partially over the at least one first opening, and wherein an opening duration is adjusted during which the piston at least partially unblocks the at least one first opening upon passing through the bottom dead center, also in the case of maintaining the position of the bottom dead center.

* * * * *